United States Patent [19]

Crane

[11] 3,987,898

[45] Oct. 26, 1976

[54] HANGER STACKING RACK

[75] Inventor: Walton B. Crane, Sherman Oaks, Calif.

[73] Assignee: A & E Allied Plastics, Los Angeles, Calif.

[22] Filed: Aug. 4, 1975

[21] Appl. No.: 601,413

[52] U.S. Cl. ..... 206/300; 229/37 R

[51] Int. Cl.[2] ..... B65D 5/02; B65D 85/00

[58] Field of Search ..... 206/300; 229/37–39

[56] References Cited

UNITED STATES PATENTS

| | | | |
|---|---|---|---|
| 627,334 | 6/1899 | Ingersoll | 229/38 |
| 3,115,968 | 12/1963 | Peterson | 206/300 |
| 3,586,233 | 6/1971 | McCulloch | 229/38 |

*Primary Examiner*—George E. Lowrance
*Assistant Examiner*—Dallas B. Farrow
*Attorney, Agent, or Firm*—Louis J. Bachand

[57] ABSTRACT

A knock-down racking box for storage of clothes hangers in department and specialty stores. The box features construction innovations enabling shipment and storage of the box as a flat blank, but ready conversion, without special tools such as staple guns, into a configuration sized to receive numerous clothes hangers horizontally disposed and vertically aligned.

10 Claims, 5 Drawing Figures

HANGER STACKING RACK

BACKGROUND OF THE INVENTION

This invention has to do with knock-down boxes and more particularly is concerned with a knock-down racking box for storage of clothes hangers such as are used to hang clothing in department and specialty stores for inspection by the customer.

It has become common for department and specialty stores which display their women's, men's and children's clothing on hangers to remove the hanger from the garment prior to packing the garment for the customer to take home. This practice has been introduced primarily as a cost-saving measure. As will be appreciated there is a rapid accumulation of clothes hangers at or about the packing station and the orderly storage of these hangers has become a considerable problem. Formerly, the practice was to casually toss the hangers into a large bin from which they could only be difficultly retrieved, if they were retrieved at all. More recently the practice has been instituted of stacking the hangers in a suitable container which maintained the hangers unentangled, the hooks not being intertwined with the shoulder portions and/or the clips found on the hangers. With the growth in the practice of so storing the hangers, the numbers of hanger racks being provided to the trade has increased and new problems have arisen in the economical handling of this business.

Typically, racking boxes for hangers have been vertically extended containers into which the hangers are stacked singly. The construction of these boxes has been a sheet of corrogated board or like sheet material folded into the desired rectangular cross-section overlapped at one side edge and stapled there for use. These containers are generally manufactured in one location and shipped to another and for this purpose may be flattened in their stapled condition. It will be evident that such a flattening process leaves a double and in some instances a triple thickness of paper board or corrogated board and may well strain the connection between the side edges at the location of the staples. Moreover, in this type of construction where the edge margin used to interconnect the front and side panels, for example with staples, projects into the interior space of the container, the introduction of hangers into the box may be impeded and tilting of hangers in the box encountered with a consequent reduction of capacity of box and/or possible entanglement of the hangers in the box.

It is therefore a major object of the present invention to provide a knock-down racking box for storage of clothes hangers which has single wall construction in all vertical walls, with no overlap, which is readily assembled on the site and which can be shipped as a single thickness box blank and yet when assembled provides a rigid high capacity hanger rack.

Other objects of the invention will become apparent hereinafter.

The objects of the invention are realized in a knock-down racking box for storage of clothes hangers of the type having right and left arm portions and an outwardly projecting portion therebetween carrying hook structure. The box comprises a unitary sheet material blank folded along predetermined lines into an elongated, generally rectangular configuration of a size to receive a series of hangers in horizontally disposed and vertically aligned relation, the box configuration being defined by a bottom wall having left and right hand slot openings formed therein, a rear wall folded upward from the bottom wall, opposed side walls fold-connected to the rear wall and extending upward from the bottom wall, left and right hand front wall panels fold-connected to their adjacent side walls, the front wall panels cooperating to define an elongated opening centrally of the box front adapted to receive the hanger neck portions in guiding relation with hook structure thereon exposed beyond the plane of the front wall panels; and fastening means maintaining the walls and panels in their folded relation, the fastening means comprising downward continued extents of the left and right hand front wall panels transversly scored to form flaps separably interlocking respective ones of said left and right hand bottom wall slots in box configuration-defining relation.

The knock-down racking box according to the invention further includes these features: downward continued extents of the side walls transversely scored to overlie the box bottom wall; handle means defined by the rear wall opposite the upper portion of the elongated front opening; each of said front wall panel flaps including a tapered portion underlying the bottom wall and an enlarged tab portion beyond the tapered portion thereof separably interfitting the opposing bottom wall slot; and single wall construction of the box throughout its vertical length above the bottom wall. Typically, the box sheet material comprises corrogated board and in such embodiments each front wall panel flap may underlie the bottom wall and include the tapered portion and a relatively enlarged tab portion beyond the tapered portion separably interfitting the opposing bottom wall slot, the downward continued extents of side walls folded to overlie the bottom wall, the front wall panel tabs standing upwardly within the box and the side wall continued extents being locally relieved to accommodate the tabs within the box, the rear wall being apertured to define handle means opposite the upper portion of the elongated front opening.

For these purposes the invention provides in a blank form a knock-down single vertical wall construction racking box blank comprising unitary corrogated board sheet material locally scored and cut to define a bottom wall having left and right hand tab-receiving slot openings, a rear wall foldable upward from the bottom wall, opposed side walls fold-connected to the rear wall and extendable upward from the bottom wall, left and right hand front wall panels, fold connected to their adjacent side wall, the front panels being cut to cooperatively define an elongated opening centrally of the box front and tab-carrying portions separably interlocking each front panel with the bottom wall at the slots therein and in underlying relation in the assembled condition of the blank.

BRIEF DESCRIPTION OF THE DRAWINGS

The invention will be further described as to an illustrative embodiment in conjunction with the attached drawing in which.

DESCRIPTION OF THE PREFERRED EMBODIMENTS

Figure 5:
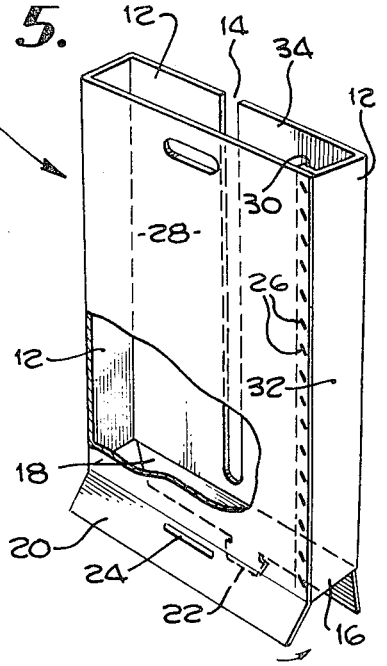
FIG. 5 is a perspective view of a prior art clothes hanger racking box.

Turning now to the drawings in detail, in FIG. 5 a prior art type of clothes hanger rack-box is shown at 10 having walls 12 defining a generally rectangular cross-section and a central vertical front opening 14. Bottom wall 16 comprises full size flaps 18, 20 which are fastened together by tab 22 in slot opening 24. The box 10 is held together by the vertical series of staples 26 which secure rear wall element 28 to the infolded side margin 30 of side wall element 32. This produces a shoulder within box 10, as shown, which may interfere with quick and easy alignment of successive hangers H within the box.

The box 10 further has the practical disadvantage of needing to be shipped folded and stapled. This will result in several wall thicknesses i.e. rear wall element 28, side wall element edge margin 30 and front wall element 34 all must be pressed together to flatten the box.

Figure 4:
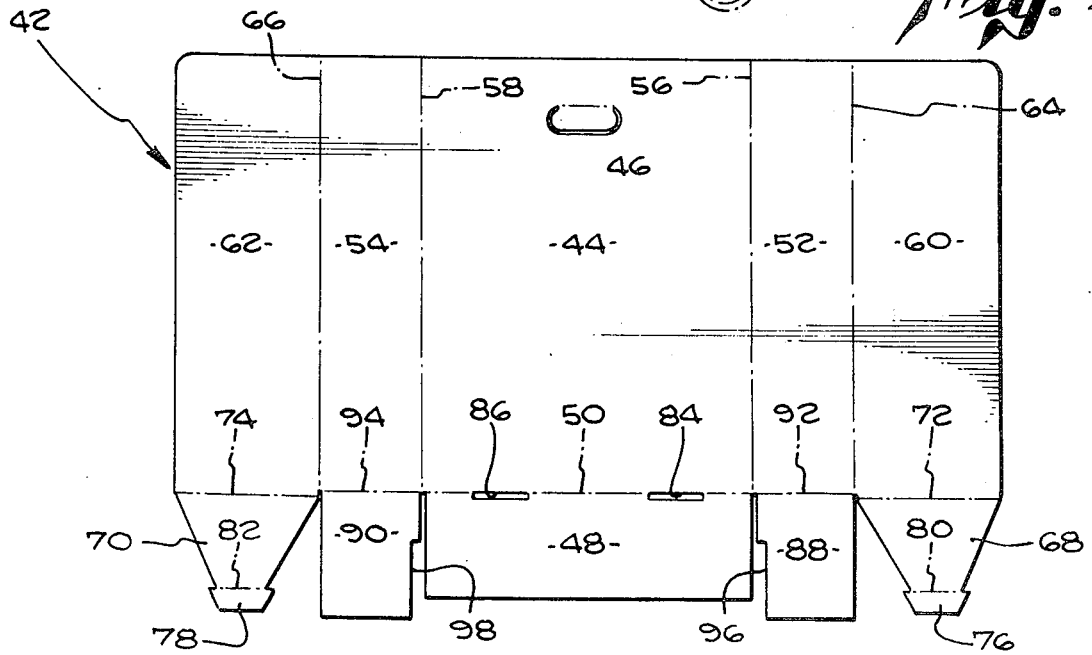
FIG. 4 is an elevation view of the box blank in the unassembled condition.

The box of the present invention may be formed and shipped as a blank. The box of the invention is shown in the assembled condition at 40 in FIG. 1 and in the non-assembled, knocked down blank form at 42 in FIG. 4. With reference further to FIG. 4 it will be seen that the block 42 is but a single thickness of unitary corrugated board (or like sheet material) scored along predetermined lines and cut to provide a rear wall 44 having therein a handle forming aperture 46, a bottom wall 48 fold-connected to the rear wall along score line 50, side walls 52, 54 fold-connected to rear wall 44 along score lines 56, 58 respectively, left and right hand front panels 60, 62 fold connected to the side walls as shown along score lines 64, 66.

The front panels are cut to have downward continued extents forming tapered portions 68, 70 as shown, away from the panel, and foldable relative thereto along score lines 72, 74 and provided with enlarged tabs 76, 78, also foldable relative to the tapered portion along score lines 80, 82.

The bottom wall 48 is provided with slots 84, 86 sized to separably interfit the tabs 76, 78 as will be described. Further the side walls 52, 54 also have downward continued extents 88, 90 foldable relative to the side walls along score lines 92, 94 and die cut at 96, 98 respectively to be locally relieved there for purposes to appear.

The just described box blank can be shipped flat and assembled on site by unskilled labor and without special tools such as costly staple guns, unlike the prior art 10 in this respect.

Other advantages accrue from the present box design which become apparent when the box blank is folded into the box configuration, one of which advantages is the smoothness of the box interior and the absence of protruding shoulders comparable to edge margin 30 in FIG. 5.

Figure 1:
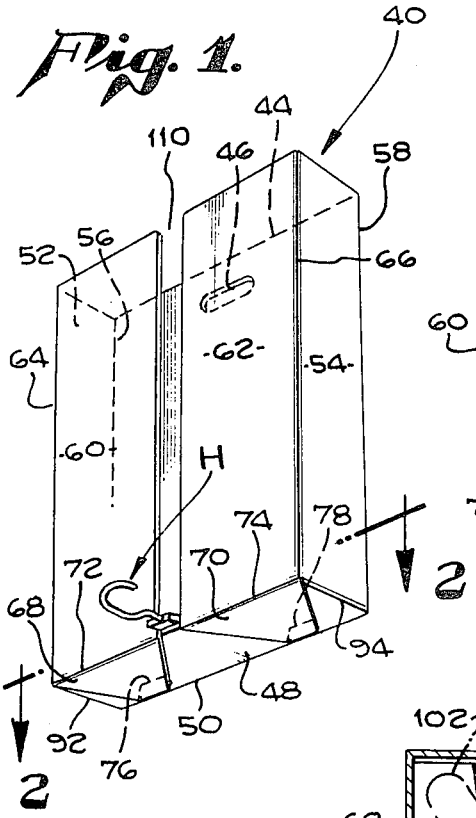
FIG. 1 is a perspective view of a knock-down racking box for clothes hangers according to the invention.
Figure 3:
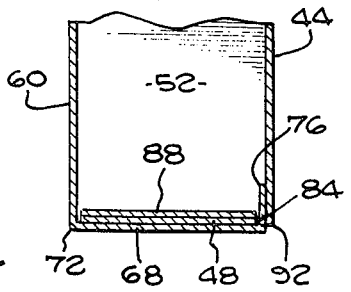
FIG. 3 is a fragmentary view taken generally along line 3—3 in FIG. 2.
Figure 2:
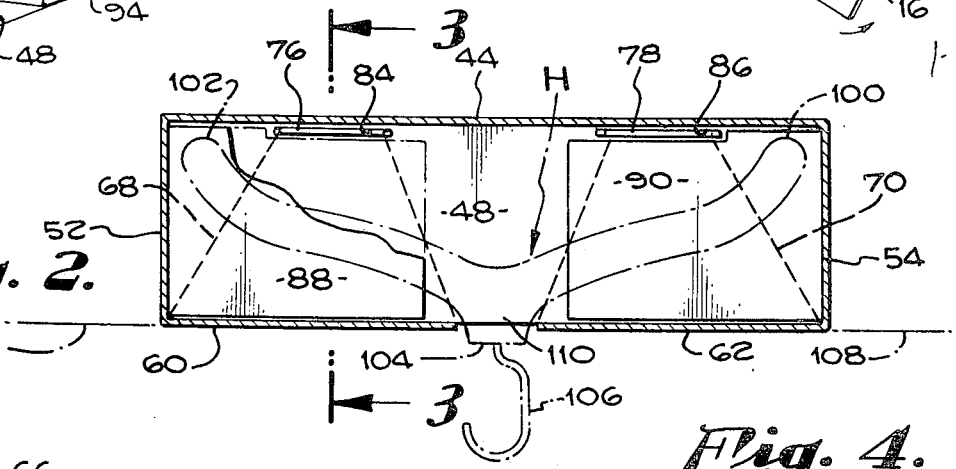
FIG. 2 is taken along line 2—2 in FIG. 1.

With reference particularly to FIGS. 1 – 3 the racking-box according to the invention comprises storage means for hangers H of the type having right and left arm portions 100, 102 and an outwardly protruding neck 104 therebetween carrying hook structure 106. The box 40 comprises the unitary sheet material blank 42 folded as shown along predetermined lines (Nos. 50, 56, 58, 64, 66, 72, 74, 80, 82, 92 and 94 in the drawing) into the elongated, generally rectangular configuration shown of a size to receive a series of hangers H in horizontally disposed and vertically aligned relation and defined by the bottom wall 40 having left and right hand slot openings 84, 86, the rear wall 44 folded upward from the bottom wall, opposed side walls 52, 54 fold-connected to the rear wall and extending upwardly from the bottom wall, left and right hand front wall panels 60, 62 fold-connected to the side walls 52, 54 respectively adjacent thereto. The front wall panels 60, 62 lie in a common plane 108 through which hanger H neck portion 104 and hook structure 106 are protrudingly exposed. The front wall panels 60, 62 further are die cut to cooperatively define elongated front opening 110 which extends vertically in the center of the box front, the handle aperture 46 being opposite the upper portion of the front opening.

The several walls of the box are received in the assembled condition by the separable interfittment of tabs 76, 78 in bottom wall slots 84, 86 thereopposite in the folded relation of the walls. The side wall continuation extents 88, 90 overlie the bottom wall 48 while the front panel continuation extents 68, 70 underlie and support the bottom wall, the tabs 76, 78 carried thereby interfitting the slots 84, 86 removably in case the box needs to be knocked down, extend into the box into the spaces 96, 98 defined by the cutaways on the side wall extents 88, 90 respectively. See FIG. 2.

Accordingly there is provided a hanger racking box which can be shipped and stored until use or following use conveniently as a flat blank and which is readily assembled without special tools or effort into a highly useful container. Assembly of the present box without need of staples saves equipment and labor costs; shipping the container without prebreaking scored lines as is possible with the invention design results in a more square configuration upon assembly than is realized when a box is stapled into a tubular form and then flattened as in the FIG. 6 box. There two scored lines are "overbroken" by flattening the box blank in the stapled condition as taught by the prior art and these overbroken liners are rigid less than the other two of the scored lines along which the box panels fold to define the box. The result is loss of rectilinearity in the prior art box, FIG. 5 which effect is axacerbated by the different sized front and side panels of the rectangular design.

Moreover, the new design disclosed herein enables the bottommost hanger neck portion to rest against the double wall bottom of the box. In the prior art device (FIG. 5) a narrow isthmus of paperboard at the bottom of the box slot 14 eventaully wears and tears, as the box is lifted, repeatedly, after filling, for removal of hangers to a storage location for eventual reuse. The new design is not prone to tearing in this manner.

I claim:

1. Knock-down racking box for storage of clothes hangers of the type having right and left arm portions and an outwardly projecting neck portion therebetween carrying hook structure, said box comprising a unitary sheet material blank folded along predetermined lines into an elongated, generally rectangular configuration of a size to receive a series of said hangers in horizontally disposed and vertically aligned relation, said box configuration being defined by: a rear wall, opposed side walls fold-connected to said rear wall and of less than one-half the rear wall width, left- and right-hand front wall panels fold-connected to their adjacent side wall and each extending less than one-half the box front width to define an elongated opening opposite said rear wall and centrally of the box front adapted to receive said hanger neck portions in guiding relation with hook structure thereon exposed beyond the plane of said front wall panels, a bottom wall extending from said rear wall and hingedly attached thereto, said bottom wall having holes at the hinge line, said front wall panels extending from said side wall and overlying said bottom wall, each said front wall panel having a locking panel extension extending across said bottom wall and having fastening means attached at the end thereof, and said means being interlocked with said holes.

2. Knock-down racking box according to claim 1 including also handle means defined by said rear wall opposite the upper portion of said elongated front opening.

3. Knock-down racking box according to claim 1 in which each said front wall panel extension includes a tapered portion underlying said bottom wall and an enlarged tab portion beyond said tapered portion separably interfitting said hole.

4. Knock-down racking box according to claim 1 in which said box is of single-wall construction throughout its vertical length above the bottom wall.

5. Knock-down racking box according to claim 4 in which said sheet material comprises corrugated board.

6. Knock-down racking box according to claim 5 in which each front wall panel extension underlies said bottom wall and includes a tapered portion and a relatively enlarged tab portion beyond said tapered portion separably interfitting the opposing bottom wall hole.

7. Knock-down racking box according to claim 6 including also downward continued extents of said side walls folded to overlie said bottom wall.

8. Knock-down racking box according to claim 7 in which said front wall panel extension tab portions stand upwardly within the box and said side wall continued extents are locally relieved to accommodate said tabs within the box.

9. Knock-down racking box according to claim 8 in which said rear wall is apertured to define handle means and opposite the upper portion of said elongated front opening.

10. Knock-down, single vertical wall construction racking box blank comprising unitary corrugated board sheet material locally scored and cut to define a rear wall opposed side walls fold-connected to the rear wall and of less than one-half the rear wall width, left and right-hand front wall panels fold-connected to their adjacent side wall and each extending less than one-half the box front width to define an elongated opening centrally of the box front, a bottom wall extending from said rear wall and hingedly attached thereto, said bottom wall having holes at the hinge line, each of said front wall panels having a locking panel extension having fastening means attached at the end thereof for interlocking with said holes in the assembled condition of the blank.

* * * * *